US007581332B2

(12) United States Patent
Conradi

(10) Patent No.: US 7,581,332 B2
(45) Date of Patent: Sep. 1, 2009

(54) SIDING ELEMENT FOR CREATING STRUCTURED FACADES OF BUILDINGS

(75) Inventor: Ulrich Conradi, Heikendorf (DE)

(73) Assignee: Laukien GmbH & Co. Beteiligungen KG, Kiel (DE)

( * ) Notice: Subject to any disclaimer, the term of this patent is extended or adjusted under 35 U.S.C. 154(b) by 38 days.

(21) Appl. No.: 11/487,358

(22) Filed: Jul. 17, 2006

(65) Prior Publication Data

US 2007/0261261 A1 Nov. 15, 2007

(30) Foreign Application Priority Data

May 11, 2006 (EP) ..... 06 009 792

(51) Int. Cl.
*G01D 21/00* (2006.01)
*G01B 3/30* (2006.01)

(52) U.S. Cl. ..... 33/646; 33/647

(58) Field of Classification Search ..... 33/646–649; 269/904; 52/547, 548, 408, 105, 99
See application file for complete search history.

(56) References Cited

U.S. PATENT DOCUMENTS

| | | | | |
|---|---|---|---|---|
| 386,329 | A * | 7/1888 | Luce et al. | 33/646 |
| 2,745,523 | A | 5/1956 | Briggs | |
| 2,794,261 | A * | 6/1957 | Fudge | 33/648 |
| 4,899,459 | A * | 2/1990 | Taggart | 33/646 |
| 5,400,519 | A * | 3/1995 | Meyer | 33/646 |
| 5,522,149 | A * | 6/1996 | Meyer | 33/646 |
| 7,222,435 | B1 * | 5/2007 | Orfield et al. | 33/648 |
| 2005/0160691 | A1 | 7/2005 | Kim | |

FOREIGN PATENT DOCUMENTS

| | | |
|---|---|---|
| DE | 202004020156 | 12/2004 |
| DE | 20 2004 020 156 | 3/2005 |
| FR | 2446364 | 1/1980 |
| FR | 2 446 364 | 8/1980 |
| GB | 1142144 | 2/1969 |
| GB | 1 391 727 | 4/1975 |
| GB | 1391727 | 4/1975 |
| GB | 2015068 | 1/1979 |
| GB | 2 015 068 | 9/1979 |
| GB | 2160003 | 5/1985 |
| GB | 2 160 003 A | 12/1985 |
| GB | 2192205 | 7/1986 |
| GB | 2205870 | 5/1987 |
| GB | 2 192 205 A | 1/1988 |
| GB | 2 205 870 A | 12/1988 |
| WO | WO 01/14659 | 3/2001 |
| WO | WO01/14659 | 3/2001 |

OTHER PUBLICATIONS

Search Report of EPO Regarding EP 06 009 792.0-1255 (Dec. 17, 2007).

* cited by examiner

*Primary Examiner*—Yaritza Guadalupe-McCall
(74) *Attorney, Agent, or Firm*—Bacon & Thomas, PLLC

(57) ABSTRACT

A siding element for creating a facade of building constructions includes a substantially slablike element having a protrusion with a two-dimensional surface, which in cross section protrudes at least out of the plane of the slablike element.

16 Claims, 7 Drawing Sheets

SIDING ELEMENT FOR CREATING STRUCTURED FACADES OF BUILDINGS

BACKGROUND OF THE INVENTION

A. Field

The invention relates to a siding element for creating a structural facade of buildings.

B. Related Art

A siding element of this type is described in as yet unpublished European Patent Application 04 030 577.3-2303.

Siding elements of this generic type, of the kind described for instance in the aforementioned as yet unpublished European patent application, are used in various forms for external coverings of buildings of various types, such as warehouse buildings, factory buildings, airport arrival and departure terminals, and agricultural sheds, as well as private homes, in order to give them a weather-resistant outer skin. Profile-rolled sheet-metal structures were originally used for these purposes and they have been and still are on the market in the form of large-area units. While now, as before, these large-area units are used for such purposes, for the sake of greater variability of use, it is increasingly desired to use smaller-area siding elements, by means of which the same or even improved weather resistance and tightness enable more-individualized design of the external structure of buildings provided with such siding elements.

This can be carried out especially well, for instance, with the siding elements that are described in the aforementioned as yet unpublished European patent application.

One fundamental characteristic of buildings, assuming a block-shaped building, for instance, is that once it has been erected, its four exterior faces (four being named solely as an example here) are each exposed to different environmental conditions, such as sunshine, rain and snow, wind and dust, and materials that are entrained or dissolved in the air, or present therein in corpuscular form. To summarize, in the final analysis all four exterior faces of what is, for instance, a block-shaped building are typically exposed to completely different environmental factors, which in turn has an influence on the building elements located behind the siding element as well as on the interior of the building. If, as has until now always been done, the building is provided on all four exterior faces (to remain with the example given here) with identical siding elements, then no account of the different environmental conditions is taken, as mentioned above as an example, which leads to the disadvantages that the exterior face on the sunny side of the building, for instance, because of sunshine, heats up more than is desirable, and despite the best insulation material on the front of or in the building construction, this heating is perceptible, while conversely the exterior face of the building exposed to the primary wind direction has heat extracted from it, which despite the best possible insulation material on the building elements next to the siding elements is also perceptible in the interior of the building.

As a result, quite different temperatures can occur in various spatial volumes in the buildings, and this effect is even more pronounced if the interior is divided up into individual zones (rooms), so that once again provisions must be made for removing heat in certain zones (using cooling devices) or supplying heat to certain zones (by means of heaters).

BRIEF SUMMARY OF THE INVENTION

It is accordingly the object of the invention to create a siding element which not only enables fast, tight and dimensionally stable cladding of facades of buildings but also makes it possible in a simple way to take the various main weather or environmental conditions that prevail on different side faces of a building into account, so that within a wide range it can be assured that without further additional technical provisions, a substantially uniform room climate in the building clad with the siding elements of the invention is achieved, and in the final analysis a building facade can be clad with only a few differently structured siding elements which have the same fundamental construction, and thus the demands made can be suitably addressed in a simple way.

According to the invention, this object is attained by means of a siding element which has a substantially slablike form, and which in cross section has at least one protrusion having a two-dimensional surface and protruding from the plane of the slablike element.

Not only can slablike siding elements advantageously be furnished that in the final analysis can have an arbitrary suitable length and an arbitrary suitable width, but also, because of the protrusion that protrudes from the plane of the slablike element, what is intrinsically as a rule a strictly flat plane, the slablike element can be at least partly profiled. Protrusion should be understood in this context to mean that the protrusion lies in another plane extending substantially parallel to the plane of the slablike element; that is, more precisely, the siding element has at least two exterior planes spaced apart from each other. As a result, given suitable dimensioning of the individual planes, the fact that sunshine is expected on a particular exterior face of the building can be suitably addressed by either reducing reflections in a specified manner and also adjusting them in a specified manner over the entire outer surface of the siding element.

The slablike element plane and the protrusion element plane formed with the protrusion can be embodied as substantially parallel, but it is also possible for them to be inclined at an acute angle to one another.

To enable joining a plurality of siding elements to one another quickly and securely and substantially without tools or external means, the slablike element has connection devices on substantially diametrically opposed sides so that, for instance, if the siding element is mounted vertically on an outer wall or sub-structure of a building, there are connection devices at the top and bottom which enable adjacent siding elements on either side to be connected to the slablike element.

To attain the goal of making the tightest possible connection with an adjacent siding element, it is advantageous for one connection device to be configured as a protrusion of strutlike cross section, and the other connection device to be configured in the form of a receiving part of U-shaped cross section. Thus in a simple way, the strutlike protrusion of the one siding element can be detachably inserted into the U-shaped receiving part of the siding element adjacent to it for making the connection. Another advantage of this kind of arrangement is that for purposes of repair, maintenance and replacement, the siding elements can be separated from one another in a simple way, because the strutlike protrusion of one siding element can simply be pulled out from the U-shaped receiving part of the siding element adjacent to it.

The possibility of replacement relates not only to the fact that possibly damaged siding elements should be capable of being replaced easily, but also that, because of structurally desired changes or altered environmental parameters that relate to a building clad according to the invention, other siding elements which are also within the scope of the invention can be installed at desired places on the building.

As already suggested at the outset, the protrusion can be embodied in the form of a substantially flat partial plane next to the slablike element plane of the siding element; this is meant to be understood to mean that the plane of the protrusion may be embodied as merely offset by a certain amount from and parallel to the slablike element plane, or may be inclined, offset by a certain amount, at a small acute angle relative to the slablike element plane.

In a further embodiment of the siding element, the protrusion in cross section has a structure in the form of a substantially U-shaped profile; advantageously, in cross section, the flanks of the protrusion join the protrusion plane and/or the slablike element plane substantially at an obtuse angle, and it may optionally be desirable to form an angle of approximately 90°.

At least when the siding element is mounted vertically, forming the angle between the slablike element plane and the protrusion plane as an obtuse angle has the advantage that water can easily drain off because of the inherent inclination of the flanks, and along with this, any dirt particles that have become deposited there can also be rinsed off. It will often be advantageous to form the flank with an angle of about 90° where the U-shaped receiving part of one siding element for receiving the strutlike protrusion of the adjacent siding element is located, to assure that the strutlike protrusion can be introduced virtually by positive engagement into the U-shaped receiving part, so that a tight connection between adjacent siding elements is assured.

Particularly, in comparison to the width between the strutlike protrusion and the U-shaped receiving part of a connecting element of very much greater length, which can amount for instance to up to 6 meters or more, it is advantageous, at least on the side of the protrusion facing the slablike element plane, to provide a plurality of protruding ribs extending in the longitudinal direction of a slablike element, which thus accomplish an easily attainable increase in the longitudinal stability of the siding element. Embodying the protruding ribs on the side of the protrusion that is not visible from outside in the mounted condition of the siding element has the further advantage that neither moisture nor dust particles can settle there as a result of weathering factors in the vicinity of the building clad according to the invention.

In addition to or alternatively, the above-described capability of increasing the stability of the siding element in the longitudinal direction, it may be advantageous at least on one side of the slablike element plane to provide at least one protuberance extending substantially in the longitudinal direction of a slablike element, which also can be provided on the side of the protrusion oriented toward the slablike element plane. The protuberance or protuberances can be configured as protuberances from the protrusion plane or of the slablike element plane, and can be protruding or recessed.

As a further provision, in addition or as an alternative to the strutlike protuberances, in accordance with still another embodiment of the siding element, it may be advantageous to include on the side of the protrusion oriented away from the slablike element plane of the slablike element, a plurality of groovelike indentations which extend substantially in the longitudinal direction of a slablike element. These groovelike indentations primarily will increase the longitudinal stability of the siding element. The groovelike indentations, which are preferably triangular in cross section, in this embodiment have the advantage that rainwater cannot accumulate in the indentations, since it flows out, and furthermore, any dirt particles that may be deposited there are rinsed out by the rainwater, so that there is no need to fear an impairment to the external esthetic impression given by the siding element from the dirt particles, yet nevertheless, especially in the case of siding elements of great length, additional stability is achieved.

To enable achieving a possibly even more purposeful degree of reflection of sunlight, which is a goal of siding elements, in still another preferred embodiment of the siding element, a plurality of bulges which extend substantially in the longitudinal direction of a slab are provided, and which protrude away from the protrusion plane and are embodied integrally with the protrusions and are embodied in cross section as substantially in the shape of part of a circle.

Depending on the number of bulges per connecting element and on the size of the radius of the partial circle, the reflection properties of the siding element for the area of a building on which the siding element is to be used can thus be purposefully adjusted or suitably taken into account, with the additional advantage that at the same time an increase in the longitudinal and transverse stability is attained because of the partially circular bulges extending in the longitudinal direction of the siding element.

The material from which the siding element can be made may in principle be an arbitrarily suitable material that is capable of withstanding the environmental influences to which a building clad with the siding elements of the invention is exposed after it has been erected. This material may for instance be metal, for example an aluminum alloy; alternatively the material may also be a plastic material, optionally fiber- or metal-reinforced. The material may also be an at least partially optically transparent material, such as an optically transparent plastic. Thus visually transparent structures can be purposefully created on a building, and even if visually transparent siding elements as described above are structurally used, there is no resultant interference with the overall existing visible appearance of a building.

DESCRIPTION OF THE DRAWINGS

The invention will now be described in detail in conjunction with the following schematic drawings in terms of various embodiments of the siding elements of the invention. In the drawings.

DETAILED DESCRIPTION OF PREFERRED EMBODIMENTS OF THE INVENTION

Figure 1:
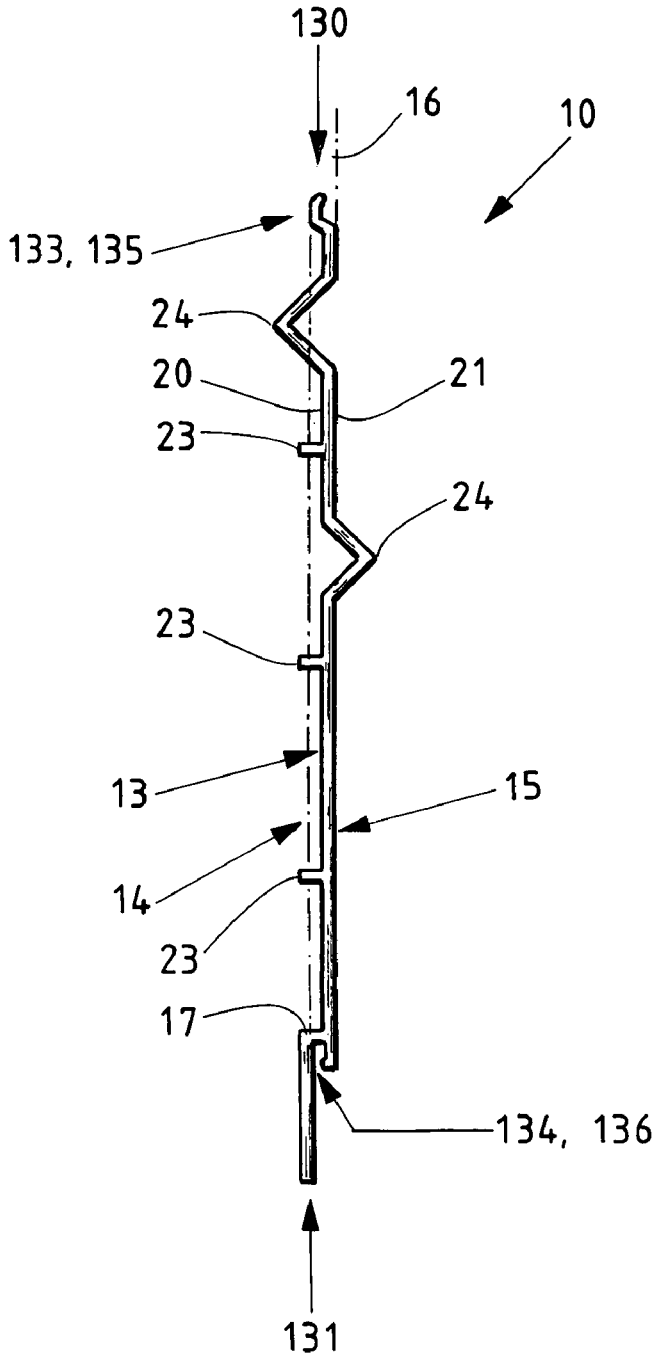
FIG. 1, in side view, shows a siding element in one structural basic form.
Figure 7:
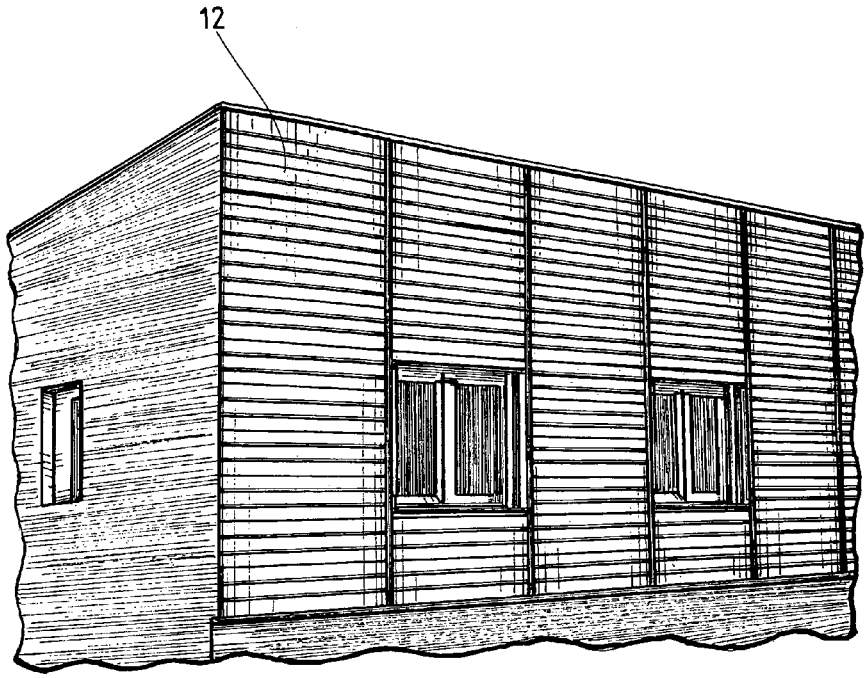
FIG. 7, in perspective, shows a building which is clad with the siding elements of the invention and in which different designs of the siding element of the invention have been employed.
Figure 8:
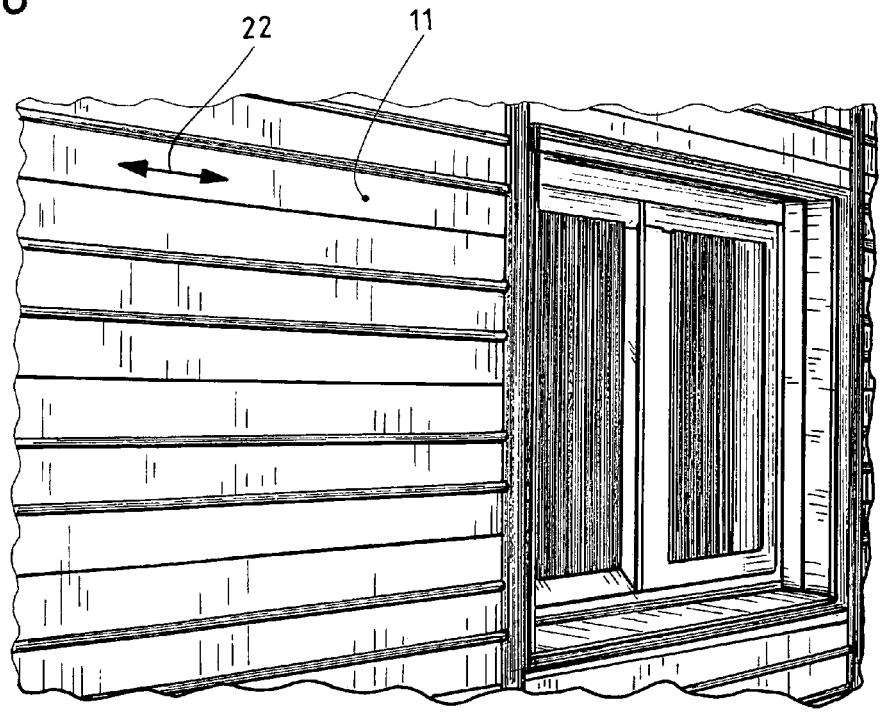
FIG. 8 is an enlarged detail of FIG. 7.

Turning first to the illustration of the siding element 10 in FIG. 1, the siding element 10 will be described in detail. The siding element 10 serves to create a facade 11 of building constructions 12, as shown in FIGS. 7 and 8. The siding element 10 substantially comprises a slablike element 13, which has a protrusion 15 that protrudes from the plane 14 of the slablike element 13. The view in FIG. 1, which also applies to FIGS. 2 through 6, is a view toward the side or end of the siding element 10. The width, or as shown in FIGS. 1 through 6, the height, of a siding element 10 is in the range of approximately 200 mm, although this is intended here only as an example for better understanding of the basic dimension of the siding element 10. For completed manufactured siding elements 10, the length of one siding element 10, or in other words the length in its longitudinal direction 22—see FIG. 8—is for instance 6 m and more, and these lengths can be cut to suit the lengths wanted or needed for a building construction or building 12 for finished siding elements 10 of the invention.

The slablike element 13, on its diametrically opposed sides 130, 131, has connection devices 133, 134, by way of which a respective adjacent siding element 10 can be connected to the siding element 10. In the siding elements 10 shown in the drawings, the connection device 133 is configured as a protrusion 135 of strutlike cross section, and the other connection device 134 is configured as a receiving part 136 of U-shaped cross section. The strutlike protrusion 135 of the one siding element 10 can be detachably introduced into the U-shaped receiving part 136 of the siding element 10 adjacent to it, for making the connection.

In principle, however, arbitrarily suitably formed connecting elements are possible in combination with the siding element 10 of the invention, so that the connecting elements described above must be considered only as one possible connection possibility, although one that has thoroughly proven itself in use; see also the detailed description of these connecting elements in connection with siding elements 10 in the European Patent Application 04 030 577.3-2303, as yet unpublished, which is hereby incorporated by reference.

Figure 2:
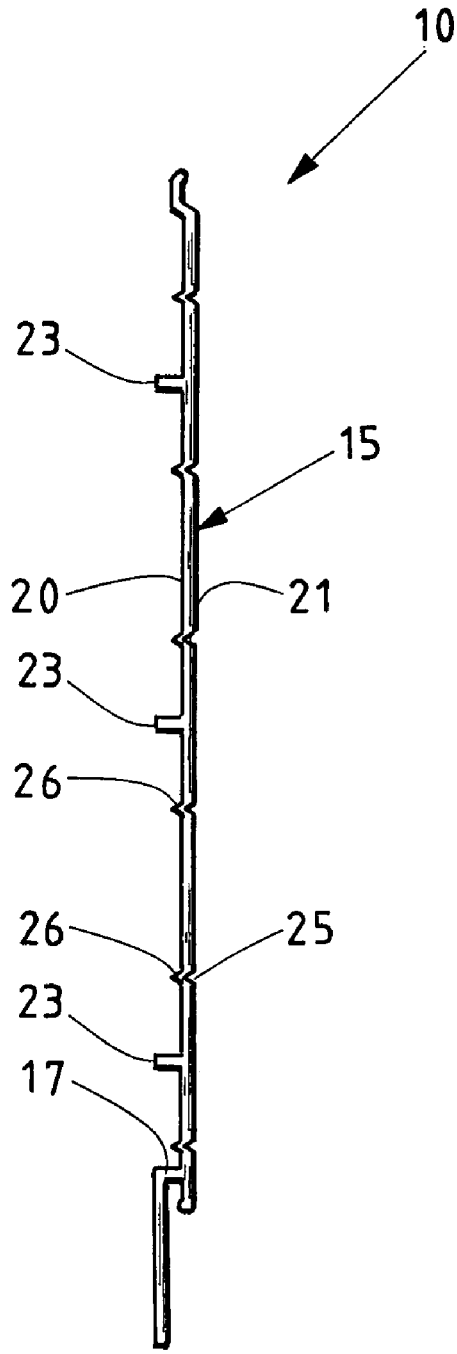
FIG. 2, in side view, shows a siding element of FIG. 1, in which groovelike indentations are provided on one side of the element and a plurality of projecting protuberances are provided on the other side of the element.

In the embodiment of the siding element 10 shown in FIG. 1, the protrusion 15 is embodied as being large, compared to the rest of the substantially slablike element 13, that it spans virtually the entire slablike element plane 14 of the siding element 10, this slablike element plane being shown in FIG. 1 as an imaginary dot-dash line, and this also applies to the embodiment of the siding element in FIG. 2.

Figure 3:
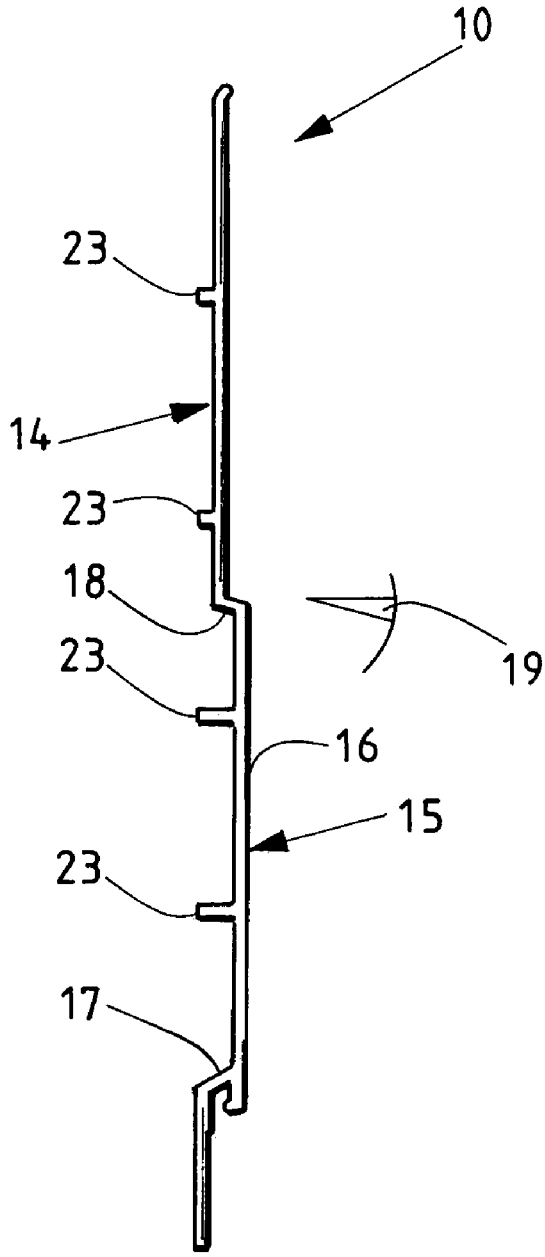
FIG. 3, in side view, shows a siding element in which an area corresponds essentially to the area of the slablike element plane, and wherein the protrusion plane is closed off by flanks that extend at obtuse angles to the slablike element plane.

In the siding element 10 of FIG. 3, the protrusion 15 in terms of its area is formed virtually as large as the area of the slablike element plane 14. The sizes of the areas of the slablike element plane 14, which can be seen as examples in the drawings, on the one hand, and of the plane 16 of the protrusion 15 on the other, must be understood as only examples. All sizes of the respective areas of the protrusions 15 or slablike element plane 16 are conceivable for the siding elements 10. For all the siding elements 10 shown here, however, it is also true that the longitudinal cross section of the protrusion 15 has a structure in the form of a U-shaped profile, which can be seen especially clearly from the illustration of the siding element 10 in FIG. 3. The flanks 17, 18, by way of which the protrusion 15 is connected to the protrusion plane 16 on the one hand and to the slablike element plane 14 on the other, connects the slablike element plane 14 with the protrusion plane 16 at an obtuse angle 19, which is exaggerated in FIG. 3 compared to the actual siding element 10 for the sake of clarity. However, this angle 19 may also be embodied as about 90° for both flanks 17, 18, or at least for one flank 17 (see FIGS. 1 and 2).

In all the siding elements 10 shown in FIGS. 1 through 6, a plurality of protruding ribs 23 extending in the longitudinal direction 22 of a slablike element are provided on the side 20 of the protrusion 15 toward the slablike element plane 14. Protruding ribs 23 may also be provided on the side 20 of the slablike element plane 14, which is shown particularly clearly for instance in the illustration of the siding element 10 in FIG. 3.

As a further provision in addition to, or as an alternative to, the protruding ribs 23, protuberances 26 may be provided, which are disposed on the side 20 toward of the protrusion plane 16 oriented toward the slablike plane 14 of the siding element 10. On the opposite side 21 of the protrusion 15, groovelike indentations 25 may be provided. In the illustration in FIG. 2, the groovelike indentations 25 and the springlike protuberances 26 are embodied as aligned with one another in the transverse direction relative to the protrusion 15. The riblike protrusions 23, the groovelike indentations 25, and the springlike protuberances 26, in the siding elements 10 shown in the drawings, extend in the longitudinal direction 22 of a slablike element (see also FIG. 8).

In addition to the ribs 23, or alternatively, at least one protuberance 24 may be provided extending substantially in the longitudinal direction of the slablike element.

Figure 4:
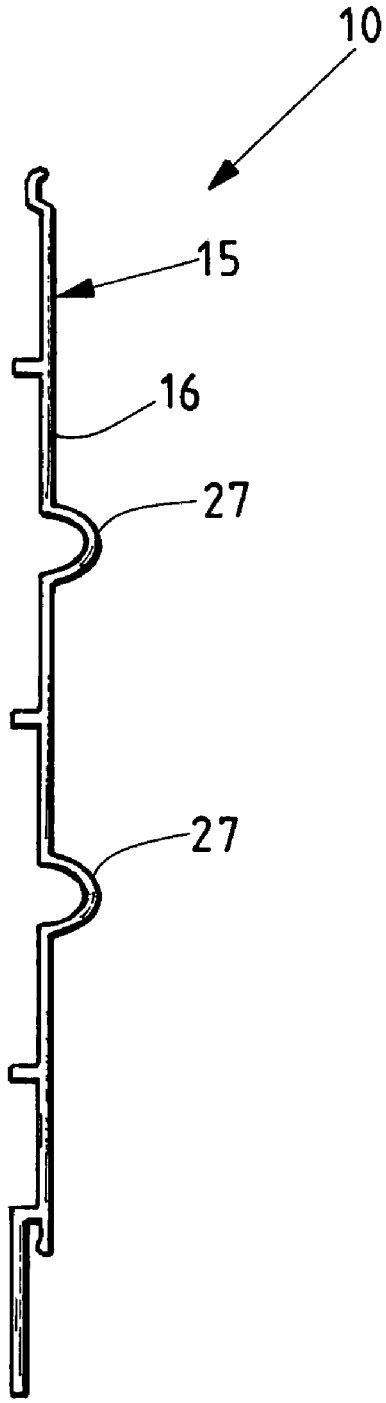
FIGS. 4-6, in side views, show siding elements in which there are a plurality of substantially partially circular bulges embodied on the protrusion plane.
Figure 5:
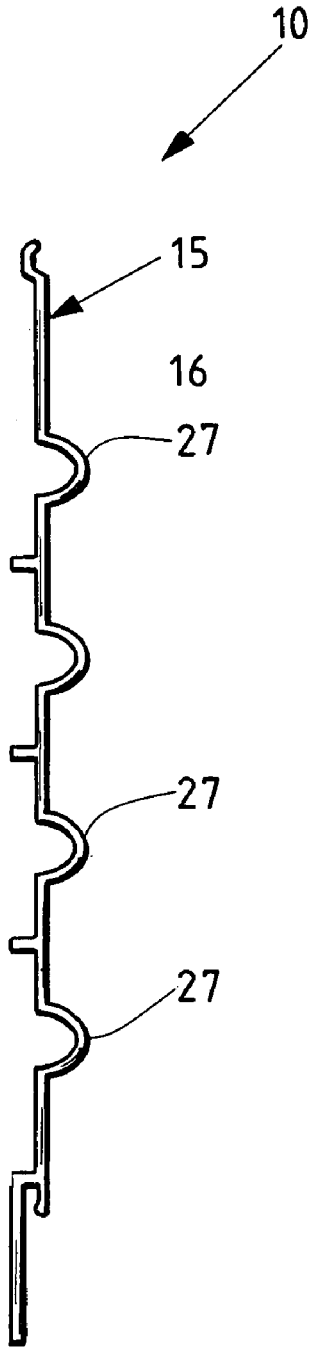
Figure 6:
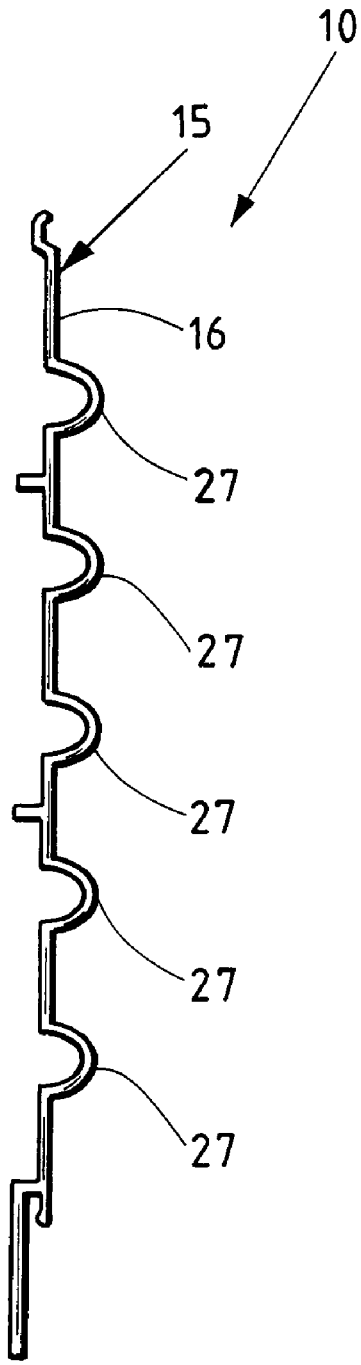

In the siding elements 10 as shown in FIGS. 4 through 6, bulges 27 are provided, which likewise extend substantially in the longitudinal direction 22 of a slablike element. The bulges 27 protrude from the protrusion plane 16 and are formed integrally with the protrusion 15. In the illustration of the siding element 10 in FIGS. 4 through 6, the bulges 27 are shown as substantially in the form of part of a circle in cross section, but it is also possible to configure them with an arbitrary other cross-sectional shape, such as the form of a portion of an ellipse or in the form of a portion of a parabola.

The siding element 10 may be produced for instance as an extruded profiled part, for instance of metal, in particular an aluminum alloy, or at least partially of an optically transparent plastic material, and optionally also of mineral-based glass.

LIST OF REFERENCE NUMERALS

10 Siding element
11 Facade
12 Building construction
13 Slablike element
130 Side of the slablike element
131 Side of the slablike element
133 Connection device
134 Connection device
135 Protrusion
136 U-shaped receiving part
14 Slablike element plane or a slab plane
15 Protrusion
16 Plane of the protrusion
17 Flank of the protrusion
18 Flank of the protrusion
19 Angle
20 Side (toward the slablike element plane)
21 Side (away from the slablike element plane)
22 Longitudinal direction of a slablike element
23 Protruding ribs
24 Strutlike protuberance
25 Groovelike indentation
26 Springlike protuberance
27 Bulge

The invention claimed is:

1. A siding element for creating a facade of buildings, comprising a substantially slablike element (13) extending in a first plane (14), which in cross section has at least one protrusion (15) having a two-dimensional surface and protruding from the first plane (14), the protrusion (15) forming a slablike structure extending in a second plane (16), wherein the slablike structure of the protrusion (15) has at least one protuberance (26) on at least one side of the second plane (16), at least one bulge (27) on at least one side of the second plane (16), and at least one protruding rib (23) on an opposite side of the second plane (16) than the bulge (27), and wherein the at least one protuberance (26), the at least one bulge (27) and the at least one protruding rib (23) extend substantially in a longitudinal direction of the slablike element (13).

2. The siding element as defined by claim 1, wherein the slablike element (13), on substantially diametrically opposite sides, has at least two connection devices (133, 134) by way of which a siding element adjacent to it can be connected to the siding element.

3. The siding element as defined by claim 2, wherein a first connection device (133) of the connection devices is embodied in the form of a protruding part (135) having a strutlike cross section, and a second connection device (134) of the connection devices is embodied in the form of a receiving part (136) of U-shaped cross section.

4. The siding element as defined by claim 3, wherein the protruding part (135) of said first connection device (133) of one siding element is configured to be detachably insertable into the U-shaped receiving part (136) of another siding element adjacent to it for making the connection.

5. The siding element as defined by claim 1, wherein the second plane (16) extends parallel to the first plane (14).

6. The siding element as defined by claim 1, wherein the protrusion (15) in transverse cross section has a structure in the form of a substantially U-shaped profile.

7. The siding element as defined by claim 1, wherein in transverse cross section, flanks (17, 18) of the protrusion (15) abut at least one of the first plane (14) and the second plane (16) substantially at an angle of about 90°.

8. The siding element as defined by claim 1, wherein in transverse cross section, flanks (17, 18) of the protrusion abut at least one of the first plane (14) and the second plane (16) substantially at an obtuse angle.

9. The siding element as defined by claim 1, wherein the at least one protruding rib is a plurality of protruding ribs (23) extending in the longitudinal direction of the slablike element (13) on at least the side of the protrusion (15) oriented toward the first plane (14).

10. The siding element as defined by claim 1, wherein a side of the protrusion (15) oriented away from the first plane (14) has a plurality of groovelike indentations (25) extending substantially in the longitudinal direction of the slablike element (13).

11. The siding element as defined by claim 10, wherein a side of the protrusion (15) oriented toward the first plane (14) has a plurality of springlike protuberances (26) extending substantially in the longitudinal direction of the slablike element (13).

12. The siding element as defined by claim 1, wherein the protrusion (15) has a plurality of bulges (27) formed integrally therewith extending substantially in the longitudinal direction of the slablike element (13), said bulges (27) protruding away from the second plane (16) and are embodied in cross section as substantially in the shape of part of a circle.

13. The siding element as defined by claim 1, wherein the siding element is formed as an extruded profile part.

14. The siding element as defined by claim 1, wherein the siding element is formed of metal.

15. The siding element as defined by claim 14, wherein the metal is an aluminum alloy.

16. The siding element as defined by claim 1, wherein the siding element is formed at least partly of glass.

* * * * *